US008630571B2

(12) United States Patent
Jung et al.

(10) Patent No.: US 8,630,571 B2
(45) Date of Patent: Jan. 14, 2014

(54) REDUCED THICKNESS FIXING UNIT TO REDUCE DEFORMATION OR FATIGUE FAILURE

(75) Inventors: Youn-gun Jung, Yongin-si (KR); Hae-seog Jo, Yongin-si (KR); Su-ho Shin, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 86 days.

(21) Appl. No.: 13/241,818

(22) Filed: Sep. 23, 2011

(65) Prior Publication Data

US 2012/0155930 A1 Jun. 21, 2012

(30) Foreign Application Priority Data

Dec. 17, 2010 (KR) ..... 10-2010-0129823

(51) Int. Cl.
*G03G 15/20* (2006.01)

(52) U.S. Cl.
USPC ..... 399/328

(58) Field of Classification Search
USPC ..... 399/328, 330, 333
See application file for complete search history.

(56) References Cited

U.S. PATENT DOCUMENTS 6,701,120 B2 * 3/2004 Nagafuji ..... 399/330
2002/0051662 A1 * 5/2002 Nagafuji ..... 399/330

FOREIGN PATENT DOCUMENTS

JP 57155571 A * 9/1982
JP 09212026 A * 8/1997
JP 10039665 A * 2/1998
JP 10221993 A * 8/1998
JP 2003173122 A * 6/2003
JP 2007025265 A * 2/2007

OTHER PUBLICATIONS

Computer translation of jp09-212026a; Aug. 15, 1997 to Echigo et al.*

* cited by examiner

*Primary Examiner* — Quana M Grainger
(74) *Attorney, Agent, or Firm* — Stanzione & Kim, LLP

(57) ABSTRACT

A fixing unit and an image forming apparatus including the fixing unit. The fixing unit includes a heating roller having an internal space in which a heating source is disposed and a pressurizing roller facing the heating roller. The heating roller has a circular hollow pipe shape and includes a fixing nip forming part which forms a fixing nip between the fixing nip forming part and the pressurizing roller. The nip forming part can have a slim part disposed at a center thereof and a pair of deformation preventing parts formed at both ends of the slim part, each deformation preventing part having a thickness thicker than a thickness of the slim part.

15 Claims, 6 Drawing Sheets

REDUCED THICKNESS FIXING UNIT TO REDUCE DEFORMATION OR FATIGUE FAILURE

CROSS-REFERENCE TO RELATED APPLICATIONS

This application claims the benefit under 35 U.S.C. §119 from Korean Patent Application No. 10-2010-0129823, filed on Dec. 17, 2010, in the Korean Intellectual Property Office, the disclosure of which is incorporated herein by reference in its entirety.

BACKGROUND OF THE INVENTION

1. Field of the Invention

The present general inventive concept generally relates to a fixing unit and an image forming apparatus including the fixing unit, and more particularly, to a fixing unit including a heating roller and a pressurizing roller, and an image forming apparatus including the fixing unit.

2. Description of the Related Art

An image forming apparatus, such as a printer, a fax machine, a copier, a multifunction peripheral (MFP), or the like, forms an image on a printing medium using an electrophotographic method. The image forming apparatus forms the image on the printing medium through charging, exposing, developing, transferring, and fixing processes.

In the fixing process, the image on the printing medium is fixed on the printing medium by a fixing unit. In general, the fixing unit includes a heating roller and a pressurizing roller to apply heat and pressure, which are necessary for fixing the image, to the printing medium. The heating roller and the pressurizing roller are disposed to face each other. Also, when the printing medium passes between the heating roller and the pressurizing roller, heat and pressure are applied to the printing medium to fix the image on the printing medium.

The pressurizing roller may have a hollow pipe shape in which a heating source, such as a heating resistor or a heating lamp, is disposed. The pressurizing roller is formed of a metal material, such as aluminum (Al) or steel, having high heat conductivity.

A time required for heating the heating roller from a room temperature to a fixing temperature is referred to as a warm-up time (WUT). A time required for performing printing on a first printing medium, i.e., a first page print out time (FPOT), increases with an increase in the WUT.

The heating roller has a hollow pipe shape, and a thickness of the heating roller may be reduced to reduce heat capacity of the heating roller in order to reduce a WUT. For example, the thickness of the heating roller may be reduced to be equal to or less than about 0.8 mm.

However, if the thickness of the heating roller is reduced to be equal to or less than 0.8 mm, the heating roller does not endure a pressurizing force of the pressurizing roller facing the heating roller and thus may cause deformation or fatigue failure thereof. In this case, durability and lifespan of the heating roller are reduced.

SUMMARY OF THE INVENTION

The present general inventive concept provides a fixing unit including a heating roller which has a thin thickness while reducing deformation or fatigue failure thereof, and an image forming apparatus including the fixing unit.

Additional embodiments of the present general inventive concept will be set forth in part in the description which follows and, in part, will be obvious from the description, or may be learned by practice of the general inventive concept.

The foregoing and/or other features and utilities of the present general inventive concept may be achieved by providing a fixing unit, including: a heating roller including an internal space in which a heating source is disposed; and a pressurizing roller facing the heating roller. The heating roller may include a nip forming part which has a circular hollow pipe shape and forms a fixing nip between the nip forming part and the pressurizing roller, and the nip forming part includes a slim part disposed in center thereof and a pair of deformation preventing parts formed at both ends of the slim part, each deformation preventing part having a thickness thicker than a thickness of the slim part.

Each of inner diameters of the deformation preventing parts may be smaller than an inner diameter of the slim part.

The thickness of the slim part may be equal to or less than 0.7 mm.

The thickness of the slim part may be between 0.2 mm and 0.7 mm.

The pressurizing roller may include a pressurizing body facing the nip forming part of the heating roller, and the deformation preventing parts of the nip forming part may respectively include overlap regions overlapping with the pressurizing body of the pressurizing roller.

Each of lengths of the overlap regions may be equal to or less than 50 mm.

Each of the lengths of the overlap regions may be between 0.5 mm and 50 mm.

The deformation preventing parts of the nip forming part may respectively further include non-overlap regions which do not overlap with the pressurizing body of the pressurizing roller.

A plurality of reinforcement ribs may be formed on an inner surface of the slim part.

The reinforcement ribs may have ring shapes and may be disposed at equal intervals from one another.

The heating roller may include: a gear coupling part to include at least one key grooves with which a heating roller gear is coupled; and a connecting part to connect the nip forming part to the gear coupling part.

The nip forming part, the gear coupling part, and the connecting part may be formed into a single body.

The foregoing and/or other features and utilities of the present general inventive concept may also be achieved by an image forming apparatus, including: a fixing unit to fix an image transferred onto a printing medium and to include a heating roller having an internal space in which a heating source is disposed and a pressurizing roller facing the heating roller. The heating roller may include a nip forming part which has a circular hollow pipe shape and forms a fixing nip between the nip forming part and the pressurizing roller. The nip forming part may include a slim part disposed in center thereof and a pair of deformation preventing parts formed at both ends at the slim part, each deformation preventing unit having a thickness thicker than a thickness of the slim part.

The thickness of the slim part may be between 0.2 mm and 0.7 mm.

The pressurizing roller may include a pressurizing body facing the nip forming part of the heating roller, and the deformation preventing parts of the nip forming part may respectively include overlap regions overlapping the pressurizing body of the pressurizing roller.

The deformation preventing parts of the nip forming part may respectively further include non-overlap regions which do not overlap with the pressurizing body of the pressurizing roller.

A plurality of reinforcement ribs may be formed on an inner surface of the slim part.

BRIEF DESCRIPTION OF THE DRAWINGS

These and/or other embodiments of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
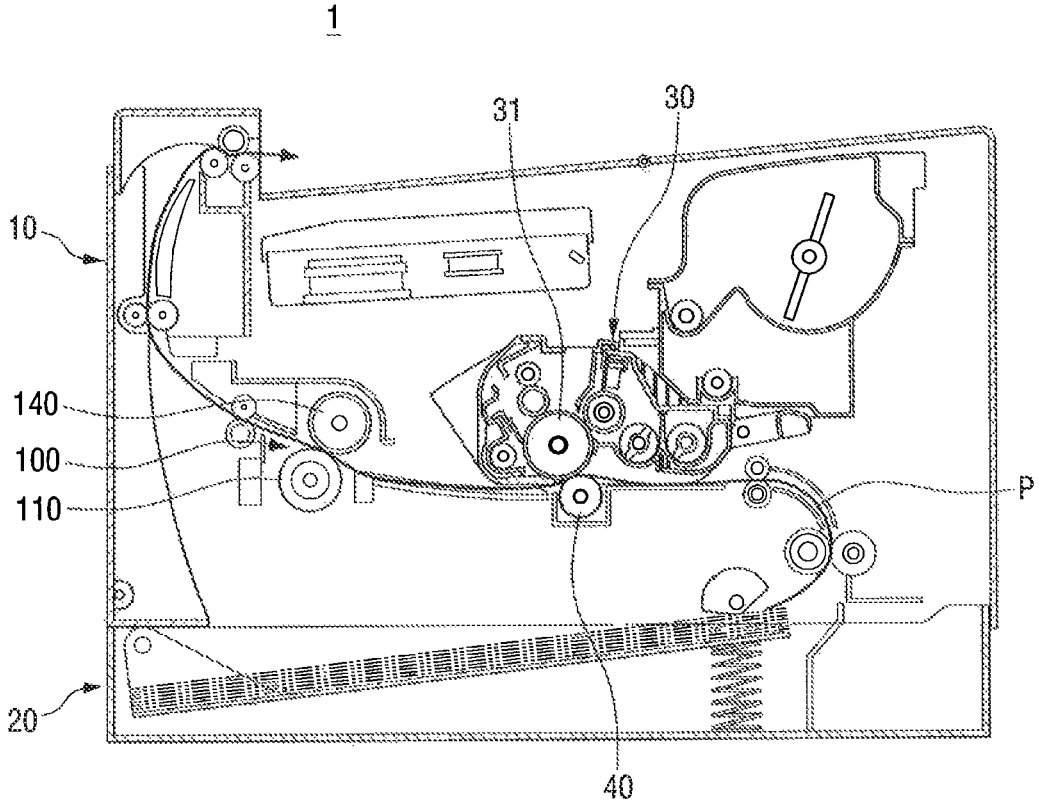
FIG. 1 is a schematic view illustrating an image forming apparatus according to an exemplary embodiment.

Reference will now be made in detail to the embodiments of the present general inventive concept, examples of which are illustrated in the accompanying drawings, wherein like reference numerals refer to like elements throughout. The embodiments are described below in order to explain the present general inventive concept by referring to the figures.

FIG. 1 is a schematic view illustrating an image forming apparatus 1 according to an exemplary embodiment.

Referring to FIG. 1, the image forming apparatus 1 includes a body 10 and a paper feeding unit 20 which is combined with a lower part of the body 10. The body 10 includes internal parts, including a developing unit 30 having an image receptor 31, a transfer roller 40, a fixing unit 100, etc.

When observing a printing medium transfer path P, while a printing medium picked up from the paper feeding unit 20 passes between the image receptor 31 and the transfer roller 40, which face each other, the printing medium receives a transferred developer image and then undergoes an image fixing process through the fixing unit 100, and is discharged outside the body 10.

The image forming apparatus 1 of FIG. 1 is illustrated as a printer which prints a single color. However, the present general inventive concept is not limited to the image forming apparatus 1 of FIG. 1 but may be applied to multipath or single-path type color printers and other types of image forming apparatuses such as a fax machine, a copier, a multifunction peripheral (MFP), etc.

Figure 2:
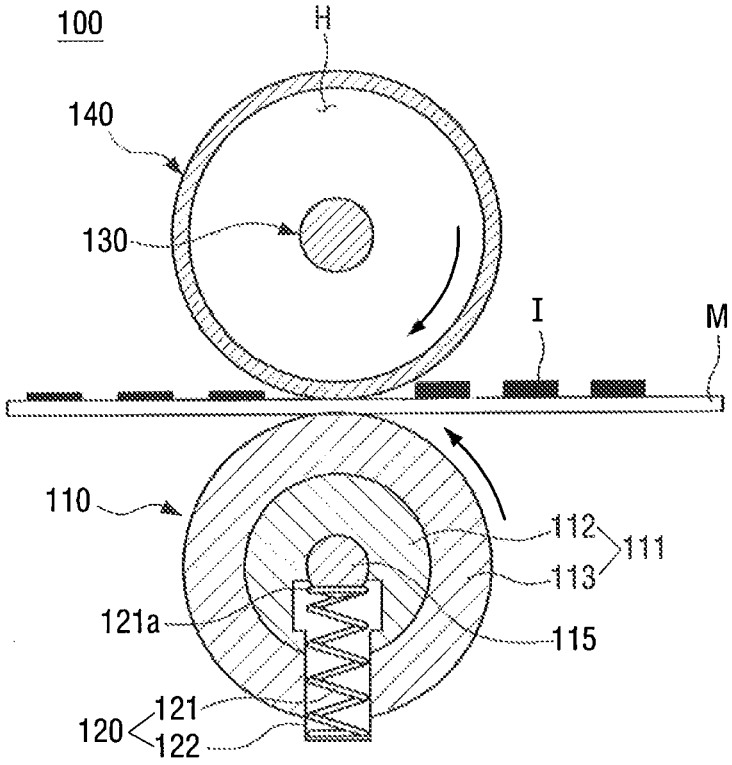
FIG. 2 is a schematic cross-sectional view illustrating a fixing unit of the image forming apparatus of FIG. 1.

FIG. 2 is a schematic cross-sectional view illustrating the fixing unit 100 of the image forming apparatus 1 of FIG. 1.

Referring to FIG. 2, the fixing unit 100 includes a pressurizing roller 110, a pressurizing source 120, a heating source 130, and a heating roller 140.

The pressurizing roller 110 includes a pressurizing body 111 and a shaft member 115, and the pressurizing body 110 includes a core member 112 which is disposed inside the pressurizing body 111 and an elastic member 113 which is disposed outside the pressurizing body 111. The shaft member 115 forms a single body along with the core member 112 and transmits a rotation force of a rotation driving device (not shown) (e.g., a motor) to the pressurizing body 111 in order to rotate the pressurizing body 111. The core member 112 includes a metal material (e.g., SUS) and has a cylindrical shape. The elastic member 113 encloses the core member 112 and is formed of an elastic material such as polyurethane.

The pressurizing source 120 includes a spring member 121 and a spring mounting member 122. The spring member 121 is a coil spring. The spring member 121 is compressed and housed inside the spring mounting member 112, and an end 121*a* of the spring member 121 contacts the shaft member 115 of the pressurizing roller 110. Therefore, a restoring force of the spring member 121 operates as a pressurizing force for pressurizing the pressurizing roller 110 onto the heating roller 140. Also, a fixing nip is formed between the pressurizing roller 110 and the heating roller 140 due to the pressurizing force.

The heating source 130 is an element which generates heat necessary for image fixing and may be a heat lamp (e.g., a halogen lamp) or a heating resistor. The heating source 130 is disposed along a rotation axis of the heating roller 140 inside the heating roller 140.

The heating roller 140 has a hollow pipe shape and an internal space H having a center in which the heating source 130 is disposed. The heating roller 140 is formed of a metal material, such as aluminum (Al) or steel, having high heat conductivity. The heating roller 140 faces the pressurizing roller 110 and rotates in an opposite direction to the pressurizing roller 110 during image fixing to form the fixing nip between the heating roller 140 and the pressurizing roller 110.

Referring to FIG. 2, when a printing medium M passes between the pressurizing roller 110 and the heating roller 140, an image I on the printing medium M is fixed by heat and pressure respectively provided from the heating roller 140 and the pressurizing roller 110.

Figure 3:
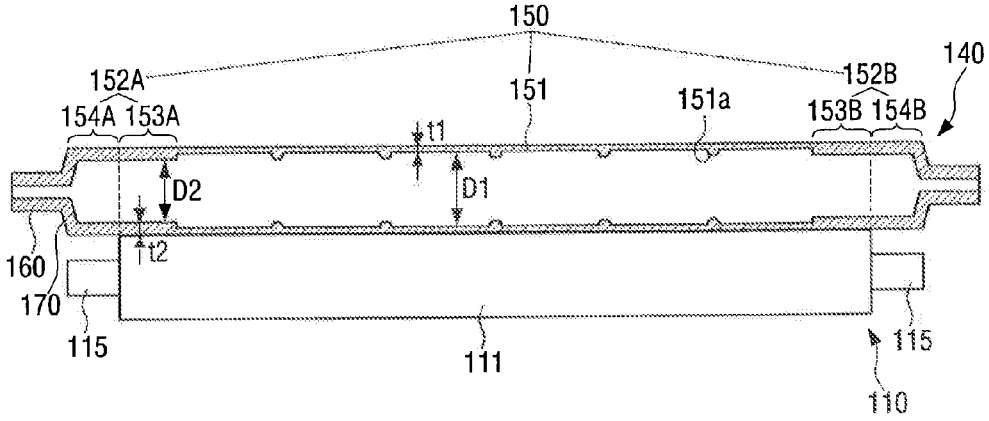
FIG. 3 shows a cross-section view of a heating roller of the fixing unit of FIG. 2 and a side view of a pressurizing roller of the fixing unit of FIG. 2.

The heating roller 140 of the fixing unit 100 of FIG. 2 will now be described in more detail with reference to FIG. 3. FIG. 3 shows a cross-section view of the heating roller 140 of the fixing unit 100 of FIG. 2 and a side view of the pressurizing roller 110 of the fixing unit 100 of FIG. 2. The heating source 120 disposed in the internal space H of the heating roller 140 is not illustrated in FIG. 3.

Referring to FIG. 3, the heating roller 140 includes a nip forming part 150, a gear coupling part 160, and a connecting part 170.

The nip forming part 150 has a circular hollow pipe. The nip forming part 150 faces the pressurizing body 111 of the pressurizing roller 110 and forms the fixing nip between the nip forming part 150 and the pressurizing body 111 of the pressurizing roller 110. Therefore, the nip forming part 150 applies heat to a printing medium passing the fixing nip formed between the heating roller 140 and the pressurizing roller 110.

The gear coupling part 160 is formed at both sides of the nip forming part 150 and has a circular hollow pipe shape like the nip forming part 150. The gear coupling part 160 includes key grooves with which a heating roller gear (not shown) is coupled and which transmit a rotation force of the rotation driving device (not shown) to the heating roller 140. Therefore, the heating roller 140 receives the rotation force of the rotation driving device through the gear coupling part 160.

The connecting part 170 connects the gear coupling part 160 to the nip forming part 150.

The heating roller 140 is formed of an aluminum material having high heat conductivity. According to another exemplary embodiment, the heating roller 140 may be formed of other types of metal materials (e.g., steel or the like) having high heat conductivity. The heating roller 140 is made as a single body. In other words, the nip forming part 150, the gear coupling part 160, and the connecting part 170 are formed into a single body.

Referring to FIG. 3 again, the nip forming part 150 of the heating roller 140 includes a slim part 151 which is disposed in the center and a pair of deformation preventing parts 152A and 152B which are disposed at both ends of the slim part 151.

The slim part 151 has a thickness t1 equal to or less than 0.7 mm, and the thickness t1 may be selected within a range between 0.2 mm and 0.7 mm. A general heating roller has a thickness equal to or greater than 0.8 mm. Therefore, the heating roller 140 of the present exemplary embodiment has a relatively thinner thickness than the general heating roller. Accordingly, the heating roller 140 of the present exemplary embodiment has a lower mass than the general heating roller. This indicates that a heat capacity of the heating roller 140 is lower than that of the general heating roller. Since the heating roller 140 of the present exemplary embodiment has a lower heat capacity than the general heating roller, a time required for heating the heating roller 140 from a room temperature to a fixing temperature is reduced more than a time required for heating the general heating roller. Accordingly, a warm-up time (WUT) and a first page print out time (FPOT) of the heating roller 140 of the present exemplary embodiment are reduced more than those of general heating rollers each having a thickness equal to or greater than 0.8 mm.

Since the thickness t1 of the slim part 151 is selected within the range between 0.2 mm and 0.7 mm, the WUT and the FPOT of the heating roller 140 are reduced. Therefore, a printing performance of the image forming apparatus 1 is improved. However, strength of the heating roller 140 is weakened due to a reduction in the thickness t1 of the slim part 151, and thus a possibility of an occurrence of deformation or fatigue failure of the heating roller 140 may increase due to pressure applied by the pressurizing roller 110.

In embodiments of the present inventive concept, a plurality of reinforcement ribs 151*a* are formed on an inner surface of the slim part 151. The reinforcement ribs 151*a* have ring shapes and protrude from the inner surface of the slim part 151. The reinforcement ribs 151*a* are disposed at equal intervals from one another in FIG. 3, but may be disposed in an alternative manner than at equal intervals from one another according to other exemplary embodiments. The strength of the heating roller 140 is improved due to the reinforcement ribs 151*a* of the slim part 151. However, if the pressurizing force of the pressurizing roller 110 is lowered enough or the slim part 151 is formed to a thickness equal to or greater than a predetermined value, the slim part 151 may be constituted without the reinforcement ribs 151*a*.

The deformation preventing parts 152A and 152B each have a thickness t2 thicker than the thickness t1 of the slim part 151. Therefore, an inner diameter D2 of each of the deformation preventing parts 152A and 152B is smaller than an inner diameter D1 of the slim part 151. The deformation preventing parts 152A and 152B compensate for the weakening of the strength of the heating roller 140 caused by a reduction in the thickness of the slim part 151. Therefore, the thickness t1 of the slim part 151 is reduced more than those of existing heating rollers, but the possibility of the occurrence of the deformation or fatigue failure of the heating roller 140 may be reduced or prevented by the deformation preventing parts 152A and 152B.

An outer diameter of the nip forming part 150 is wholly uniformly illustrated in FIG. 3 but actually increases from a inner part to an outer part in a longitudinal direction. Therefore, an outer diameter of each of both ends of the nip forming part 150 is larger than an outer diameter of a central part of the nip forming part 150. However, a change in the outer diameter of the nip forming part 150 is not recognizable. Since the outer diameter of each of the both ends of the nip forming part 150 is larger than the outer diameter of the central part of the nip forming part 150, the heating roller 140 pulls a printing medium in a vertical direction to an advancing direction of the printing medium when the printing medium passes the fixing nip. Therefore, the printing medium may be prevented from wrinkling when passing the fixing nip.

As described above, the outer diameter of each of the both ends of the nip forming part 150 is designed to be larger than the outer diameter of the central part of the nip forming part 150 to prevent the printing medium from wrinkling. Therefore, the both ends of the nip forming part 150 of the heating roller 140 receive a greater amount of the pressurizing force of the pressurizing roller 110 than other parts of the nip forming part 150. Accordingly, strengths of the both ends of the nip forming part 150 are required to be reinforced to prevent the heating roller 140 from being deformed by the pressurizing force of the pressurizing roller 110. In consideration of this point, if the deformation preventing parts 152A and 152B are formed at the both ends of the slim part 151, the heating roller 140 is effectively prevented from being deformed.

Referring to FIG. 3, the deformation preventing parts 152A and 152B respectively includes overlap regions 153A and 153B and non-overlap regions 154A and 154B.

The overlap regions 153A and 153B are parts of the deformation preventing parts 152A and 152B which overlap with the pressurizing body 111 of the pressurizing roller 110. In other words, the overlap regions 153A and 153B correspond to parts which contact the pressurizing body 111 of the pressurizing roller 110 and thus form the fixing nip. The non-overlap regions 154A and 154B correspond to parts which do not overlap with the pressurizing body 111 of the pressurizing roller 110 and are exposed outside the pressurizing body 111 of the pressurizing roller 110. In other words, the non-overlap regions 154A and 154B correspond to parts which do not contact the pressurizing body 111 of the pressurizing roller 110 and do not form the fixing nip.

The overlap regions 153A and 153B are parts which form the fixing nip between the overlap regions 153A and 153B and the pressurizing body 111 of the pressurizing roller 110 and thus receive a high amount of pressure from the pressurizing roller 110. The non-overlap regions 154A and 154B are parts which do not form the fixing nip and therefore do not receive such a high amount of pressure from the pressurizing roller 110. Therefore, it is a feature of embodiments of the present inventive concept that the deformation preventing parts 152A and 152B include the overlap regions 153A and 153B to reinforce the strength of the heating roller 140.

Since the deformation preventing parts 152A and 152B are formed thicker than the slim part 151 as described above, the heat capacity of the heating roller 140 increases with an increase in the length of the deformation preventing parts 152A and 152B. If considering that a WUT and a FPOT increase with the increase in the heat capacity of the heating roller 140, the lengths of the deformation preventing parts 152A and 152B are limited within an appropriate range to prevent the heat capacity of the heating roller 140 from excessively increasing. Therefore, the overlap regions 153A and 153B of the deformation preventing parts 152A and 152B each have a length which is limited to 50 mm or less. If the lengths of the overlap regions 153A and 153B are too short, strength reinforcement functions of the deformation preventing parts 152A and 152B may be greatly lowered. Therefore, each of the lengths of the overlap regions 153A and 153B is set to be equal to or greater than 0.5 mm. Accordingly, each of the lengths of the overlap regions 153A and 154B may be selected within a range between about 0.5 mm and 50 mm.

A strength test was performed with respect to the heating roller 140 of FIG. 3 to check the strength of the heating roller 140. The heating roller 140 of FIG. 3 and other types of heating rollers shown in FIGS. 4 and 5 were applied in the strength test.

Figure 4:
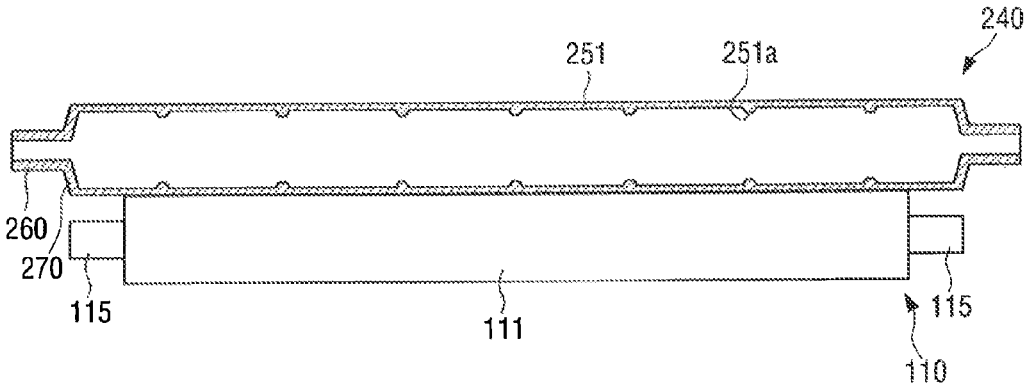
FIGS. 4 and 5 are views respectively illustrating other types of heating rollers compared with the heating roller of FIG. 3.
Figure 5:
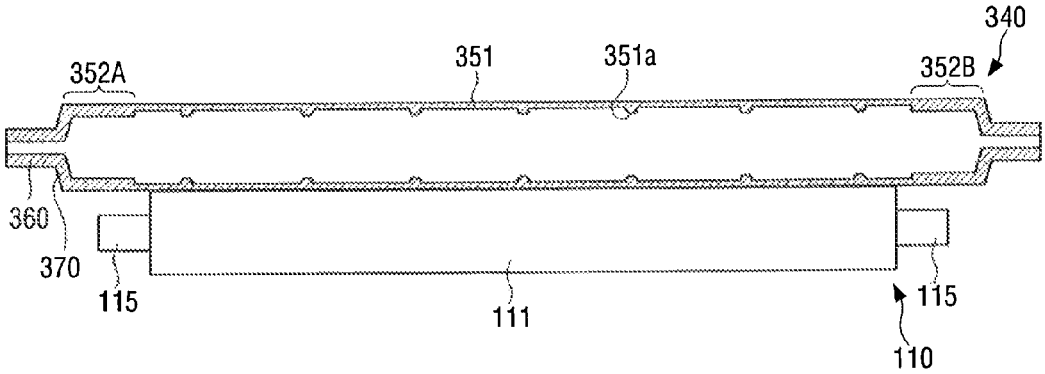

FIGS. 4 and 5 respectively illustrate other types of heating rollers compared with the heating roller 140 of FIG. 3. However, a heating roller 240 of FIG. 4 is different from the heating roller 140 of FIG. 3 in that deformation preventing parts are not formed at both ends of a slim part 251. A plurality of reinforcement ribs 251*a* are formed on an inner surface of the slim part 251 to improve strength of the heating roller 240. A heating roller 340 of FIG. 5 is similar to the heating roller 140 of FIG. 3 in that a plurality of reinforcement ribs 351*a* are formed on an inner surface of the slim part 351, and deformation preventing parts 352A and 352B are formed at both ends of the slim part 351. However, the heating roller 340 is different from the heating roller 140 in that the deformation preventing parts 352A and 352B do not include overlap regions (refer to 153A and 153B of FIG. 3).

Figure 6:
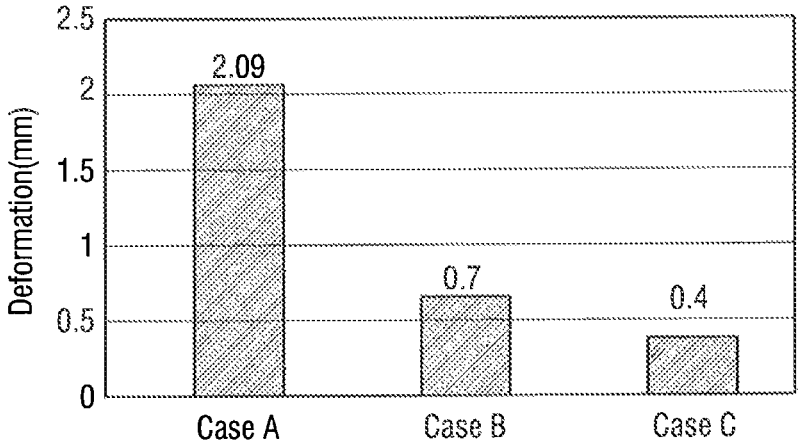
FIG. 6 is a graph illustrating results of a strength test performed with respect to the heating rollers of FIGS. 3 through 5.

In order to perform the strength test, heating rollers were placed on a V-block, a force of 20 kgf was applied to the heating rollers at a constant speed, and deformations of the heating rollers were measured. FIG. 6 is a graph illustrating results of the strength test performed with respect to the heating rollers 140, 240, and 340 of FIGS. 3 through 5.

Referring to FIG. 6, Case A, Case B, and Case C respectively illustrate the results of the strength test performed with respect to the heating roller 240 of FIG. 4, the heating roller 340 of FIG. 5, and the heating roller 140 of FIG. 3. The heating roller 140 of FIG. 3 including the overlap area 153 having the length of 3 mm was applied in the strength test.

The heating roller 240 of FIG. 4, the heating roller 340 of FIG. 5, and the heating roller 140 of FIG. 3 respectively have deformations of 2.09 mm, 0.7 mm, and 0.4 mm.

The heating roller 240 of FIG. 4 has the greatest deformation of 2.09 mm which is similar to that of a plastic deformation range. Therefore, strength of the heating roller 240 of FIG. 4, which includes the slim 251 having only the reinforcement ribs 251*a* and not having deformation preventing parts, is considerably weaker than the heating rollers of FIGS. 3 and 5. In other words, there is a limit to the improvement of strength of a heating roller using only reinforcement ribs.

The heating roller 340 of FIG. 5 and the heating roller 140 of FIG. 3 respectively have the deformations of 0.7 mm and 0.4 mm. Since the deformations of 0.7 mm and 0.4 mm belong to that of elastic range, the heating roller 340 will likely return to an original state thereof when pressure applied to the heating roller 340 is removed. Therefore, strengths of the heating rollers 340 and 140, which respectively include slim parts having reinforcement ribs and deformation preventing parts formed at both ends of the slim parts, considerably increase more in strength than a heating roller not having deformation preventing parts. Also, it is has been determined in these tests that overlap regions (refer to 153A and 153B of FIG. 3) of deformation preventing parts of a heating roller are advantageous to the improvement of strength of the heating roller, from at least the fact that the deformation (0.4 mm) of the heating roller 140 of FIG. 3 is less than the deformation (0.7 mm) of the heating roller 340 of FIG. 5.

As described above, according to embodiments of the present general inventive concept, a thickness of a heating roller is selected within a range between 0.2 mm and 0.7 mm. Therefore, a WUT and a FPOT of the heating roller are reduced to a greater degree than those of a general heating roller having a thickness equal to or greater than 0.8 mm. Also, deformation preventing parts are formed at both ends of a nip forming part of the heating roller in order to compensate for weakening of strength of the heating roller caused by a reduction in the thickness of the heating roller. Accordingly, a possibility of an occurrence of deformation or fatigue failure of the heating roller decreases, thereby improving durability and lifespan of the heating roller.

Although various example embodiments of the present general inventive concept have been illustrated and described, it will be appreciated by those skilled in the art that changes may be made in these example embodiments without departing from the principles and spirit of the general inventive concept, the scope of which is defined in the appended claims and their equivalents.

What is claimed is:

1. A fixing unit, comprising:

a heating roller having an internal space in which a heating source is disposed, the heating roller comprising:

a nip forming part which has a circular hollow pipe shape and forms a fixing nip between the nip forming part and a pressurizing roller, the nip forming part including:

a slim part disposed in center thereof, and a pair of deformation preventing parts formed at both ends of the slim part and each having a thickness thicker than a thickness of the slim part; and a pressurizing roller facing the heating roller, wherein the pressurizing roller comprises a pressurizing body facing the nip forming part of the heating roller, and where the deformation preventing parts of the nip forming part respectively comprise overlap regions to overlap with the pressurizing body of the pressurizing roller.

2. The fixing unit as claimed in claim 1, wherein each of inner diameters of the deformation preventing parts is smaller than an inner diameter of the slim part.

3. The fixing unit as claimed in claim 2, wherein the thickness of the slim part is equal to or less than 0.7 mm.

4. The fixing unit as claimed in claim 3, wherein the thickness of the slim part is between 0.2 mm and 0.7 mm.

5. The fixing unit as claimed in claim 1, wherein the lengths of each of the overlap regions is equal to or less than 50 mm.

6. The fixing unit as claimed in claim 5, wherein the lengths of each of the overlap regions is between 0.5 mm and 50 mm.

7. The fixing unit as claimed in claim 1, wherein the deformation preventing parts of the nip forming part respectively further comprise non-overlap regions which do not overlap with the pressurizing body of the pressurizing roller.

8. The fixing unit as claimed in claim 1, wherein a plurality of reinforcement ribs are formed on an inner surface of the slim part.

9. The fixing unit as claimed in claim 8, wherein the reinforcement ribs have ring shapes and are disposed at equal intervals from one another.

10. The fixing unit as claimed in claim 1, wherein the heating roller further comprises:

a gear coupling part having at least one key groove with which a heating roller gear is coupled; and a connecting part to connect the nip forming part to the gear coupling part.

11. The fixing unit as claimed in claim 10, wherein the nip forming part, the gear combining part, and the connecting part are formed as a single body.

12. An image forming apparatus, comprising:

a fixing unit to fix an image transferred onto a printing medium, the fixing unit including a heating roller having an internal space in which a heating source is disposed and a pressurizing roller facing the heating roller, wherein the heating roller comprises a nip forming part which has a circular hollow pipe shape and forms a fixing nip between the nip forming part and the pressurizing roller, and wherein the nip forming part comprises a slim part disposed at a center thereof and a pair of deformation preventing parts formed at both ends of the slim part, each deformation preventing part having a thickness thicker than a thickness of the slim part, wherein the pressurizing roller comprises a pressurizing body facing the nip forming part of the heating roller, and wherein the deformation preventing parts of the nip forming part respectively comprise overlap regions overlapping the pressurizing body of the pressurizing roller.

13. The image forming apparatus as claimed in claim 12, wherein the thickness of the slim part is between 0.2 mm and 0.7 mm.

14. The image forming apparatus as claimed in claim 12, wherein the deformation preventing parts of the nip forming part respectively further comprise:

non-overlap regions which do not overlap with the pressurizing body of the pressurizing roller.

15. The image forming apparatus as claimed in claim 12, wherein a plurality of reinforcement ribs are formed on an inner surface of the slim part.

* * * * *